US005241719A

United States Patent [19]

Memmelaar

[11] Patent Number: 5,241,719

[45] Date of Patent: Sep. 7, 1993

[54] LID REMOVAL TOOL FOR RAPIDLY REMOVING SEALED COVERS FROM LARGE CANS OR BUCKETS

[76] Inventor: Herman K. Memmelaar, 23379 Freezeout Rd., Caldwell, Id. 83605

[21] Appl. No.: 879,327

[22] Filed: May 7, 1992

[51] Int. Cl.[5] ..... B67B 7/44

[52] U.S. Cl. ..... 7/156; 81/3.09; 81/3.55

[58] Field of Search ..... 7/105, 143, 144, 151, 7/156, 146, 147; 81/3.07, 3.09, 3.55, 3.57

[56] References Cited

U.S. PATENT DOCUMENTS

| | | | |
|---|---|---|---|
| 356,925 | 2/1887 | Chamberlin | 7/147 X |
| 1,598,420 | 8/1926 | Brossett | 7/105 |
| 4,492,132 | 1/1985 | Obey | 81/3.57 X |
| 4,747,173 | 5/1988 | Marceau | 81/3.09 X |
| 4,974,441 | 12/1990 | Keeney et al. | 81/3.55 X |

*Primary Examiner*—James G. Smith
*Attorney, Agent, or Firm*—William J. Bethurum

[57] ABSTRACT

A new and improved tool for rapidly removing sealed covers from large paint buckets, oil buckets, and the like and comprising a handle having a hammer member affixed to one end thereof and a hook member extending away from the handle at a predetermined angle. The hook member has a slot therein defining a pair of hook ends, and a cutting blade member is located in the slot and is joined to the hook member. The blade member has a cutting edge of the same general contour as that of the pair of hook ends, and the blade member is thus partially protected from exposure to users during both transport and operation. A first upward torquing motion of the tool member is used to pull the cutting edge of the blade through slots or grooves in the edge of the lid being removed, whereas a second upward torquing motion of the tool is made after the lid edge has been inserted between the end of the cutting blade and a pair of hook ends located on each side thereof. This operation minimizes slippage and twisting of the hook member on the lid being removed to thereby in turn enhance the efficiency and mechanical advantage of tool operation.

7 Claims, 2 Drawing Sheets

LID REMOVAL TOOL FOR RAPIDLY REMOVING SEALED COVERS FROM LARGE CANS OR BUCKETS

TECHNICAL FIELD

This invention relates generally to can openers for removing lids from large cans or buckets, and more particularly to a multi-functional tool for removing tightly sealed lids from large paint buckets, large oil buckets and the like.

BACKGROUND ART

Large buckets such as five gallon buckets for housing and transporting a variety of liquids such as paint, industrial oils and related materials, cooking oils and the like are generally universal in construction and carry a lid or cover which is tightly sealed around the top rim of the cylindrical bucket walls. These lids are generally constructed to have a lower lip which extends at a certain angle with respect to vertical so as to enable a lid removal tool to more easily apply an upward torquing force to the lid when it is desired to open the can or bucket. In addition, the vertical cylindrical walls of the cover normally have open slots or thin grooves therein which first must be cut through to release the press fit force which, together with a sealant, tightly holds the lid in place prior to usage.

As a result of the above combination of the press fit lid and sealant between the lid and the top rim of the bucket, these lids have been extremely difficult to remove, even when using tools which are specifically designed for such lid removal.

Once such tool employs a C-shaped cavity at one end of a handle typically molded in plastic, and an example of such a tool is disclosed in U.S. Pat. No. 4,967,436 issued to Russell, incorporated herein by reference.

Another such tool comprises an elongated flat piece with prongs and spikes on one surface thereof for piercing the slots in the bucket and for leveraging against the sides of the lid and the sides of the bucket during lid removal. An example of such a tool is disclosed in U.S. Pat. No. 4,631,769 issued to White, also incorporated herein by reference.

Generally speaking, all of the above prior art lid removal tools are inefficient in operation, difficult and unsafe to handle, and are simply unable to allow the user to rapidly and easily remove the above described tightly sealed lids from large buckets, particularly by not-so-strong and able bodied persons. It is the solution to this latter problem to which the present invention is directed.

SUMMARY OF INVENTION

The general purpose and principal object of the present invention is to provide a novel alternative tool construction with respect to the above prior art tools or any other known prior art lid removal tools. This construction represents a fundamental breakthrough in lid opener tool construction which will make it easy for women and children alike to rapidly, easily, and safely remove these lids with an absolute minimum of exposure to the sharp cutting edge of the lid removal tool.

Another object of this invention is to provide a new and improved lid removal tool of the type described which is operative by weak and strong alike to rapidly remove the above tightly sealed lids from large buckets or cans.

Another object of this invention is to provide a new and improved lid removal tool of the type described which is safe to handle and operate.

Another object of this invention is to provide a new and improved lid removal tool of the type described which is elegantly simple, straightforward and reliable in construction and has a high price-performance figure of merit.

Another object of this invention is to provide a new and improved lid removal tool of the type described which is highly efficient in the mechanical advantage it affords to a user during a series of identical upward torquing motions. These torquing motions are exercised around the outer sides of the sealed lid to first cut through the above slots or grooves in the lids and then to subsequently pull up on the lip of the lid or cover with a relatively easy and highly efficient torquing motion during which the completion of lid removal from the rim of a large bucket or can can be accomplished.

To accomplish the above purpose and objects, I have developed and constructed a new and improved lid removal tool which comprises a handle having a hammer member affixed to one end thereof and a hook member spaced a predetermined distance from the hammer member and extending away from the handle and having a slot therein defining a pair of hook ends. A blade member is located in the slot between these hook ends and is joined to the hook member, and the blade member has a cutting edge of the same general curvature or contour as that of the pair of hook ends. The end surface of the blade member is spaced from the pair of hook ends by approximately the thickness dimension of a lid to be removed. In operation, an initial upward thrust of the handle is used to pull the blade cutting edge through the slots or grooves in the lid edge, and a subsequent upward thrust of the handle is made after placing the lid edge between the blade end and the pair of hook ends. This approach and operation prevents or minimizes slippage of the tool on the lid edge and thus enhances the efficiency and mechanical advantage during lid removal.

The above brief summary of the invention, together with its various objects, advantages, and novel features, will become more readily apparent with reference to the following description of the accompanying drawings.

DETAILED DESCRIPTION OF THE DRAWINGS

Figure 1:
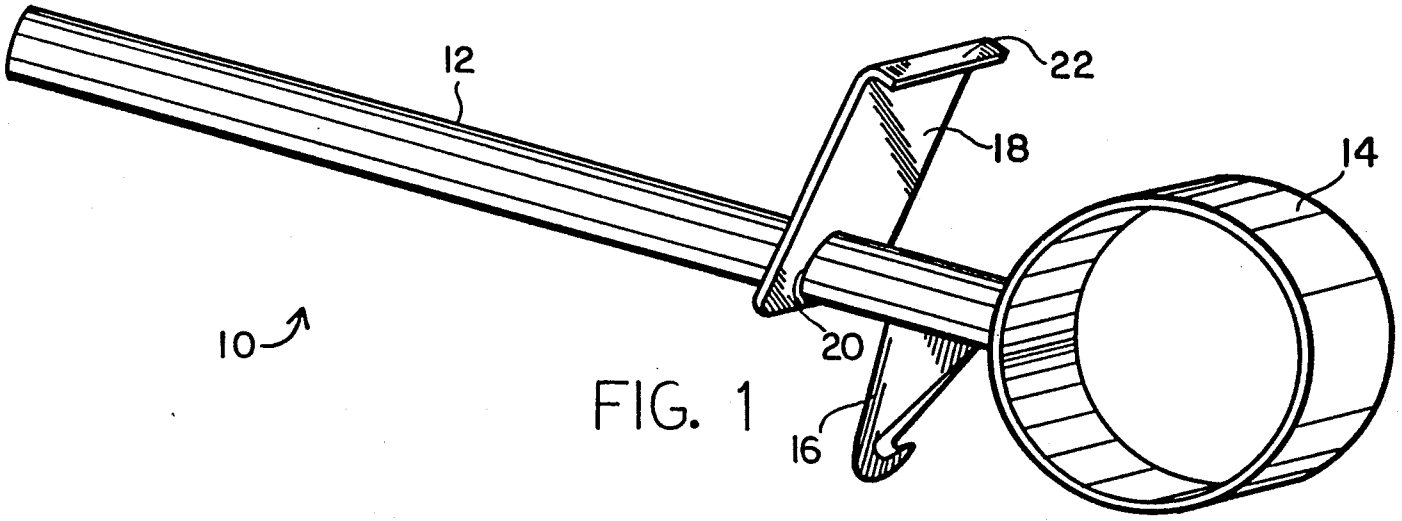
FIG. 1 is a perspective view of a lid removal tool in accordance with a first embodiment of this invention.

Referring now to FIG. 1 a lid removal tool shown in this figure is designated generally as 10 and represents a first embodiment of this invention. The lid removal tool includes a handle 12 having a cylindrically shaped hammer 14 secured to one end thereof. The hammer member 14 will typically be made of tool steel and will be welded to the elongated metal handle 12. Similarly, a blade member 16 is welded to the underside of the handle member 12, whereas a hook member 18 has an opening 20 therein through which the handle 12 passes and at which the hook member 18 is also welded to the handle 12.

In operation, the hammer 14 will be placed on top of the lid cover to be removed, and initially the blade member 16 will be used to cut through the open slots or grooves in the side walls of a lid cover to first release tension within the lid cover in preparation for a subsequent reorientation of the tool 10 to now place the hook end 22 of the hook member 18 onto the lower edges of the lid cover. This placement is made prior to producing an upward torquing motion a number of times around the edges of the lid in an effort to remove the lid from the large bucket or can upon which it is disposed.

One disadvantage of the lid removal tool shown in FIG. 1 is that the exposed protruding blade member 16 produces a significantly safety hazard for the user. Secondly, the operation of the tool in FIG. 1 requires a 180° orientation change between the above described cutting and torquing steps. Thirdly, using the lid removal tool in FIG. 1, there is no way to firmly secure the edge of the lid being removed onto the curved surfaces of the ends 22 of the hook member 18. Therefore, it is the solution to all of these problems to which the embodiment of FIG. 2 is directed.

Figure 2:
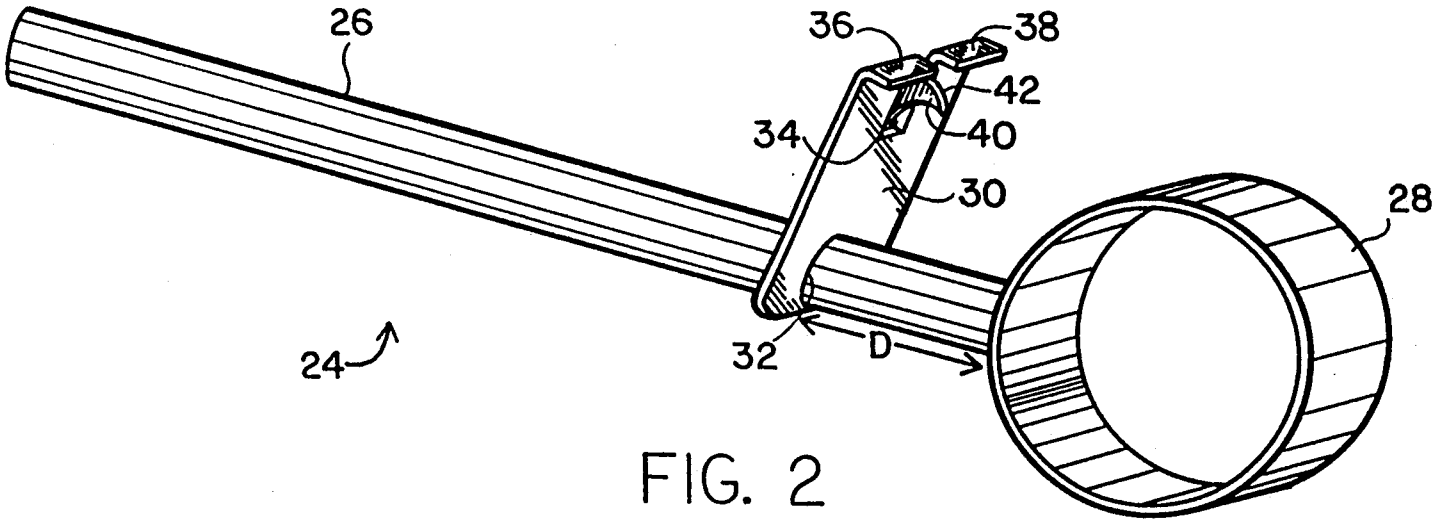
FIG. 2 is a perspective view of the lid removal tool constructed in accordance with a second embodiment of the present invention.

Referring now to FIG. 2, the novel lid removal tool constructed in accordance with the present invention and shown in perspective view is designated generally as 24 and includes a handle 26 having a cylindrical tool steel hammer 28 affixed to one end thereof. A hook member 30 having an opening 32 therein is fit welded around the outer periphery of the handle member 26 and includes a rectangular slot 34 therein defining the inner edges of a pair of hook ends 36 and 38. A cutting blade 40 is located in the center of the slot 34 and is secured at one end thereof to the top edge or wall of the slot 34. The blade 40 has an upper cutting edge 42 being of the same general curvature or contour as that of the ends 36 and 38 of the hook member 30.

The hook member 30 will typically be spaced a distance D of approximately 2⅛ inches from the cylindrical hammer 28 and will be angled at a predetermined angle Θ of approximately 10–15 degrees with respect to vertical. In addition, the edge 42 of the cutting blade 40 will be spaced from the hook ends 36 and 38 by a distance approximately equal or slightly less than the thickness dimension of the lid or cover to be removed, thereby ensuring that the tool does not unduly slip, twist or otherwise move during lid removal.

Figure 3A:
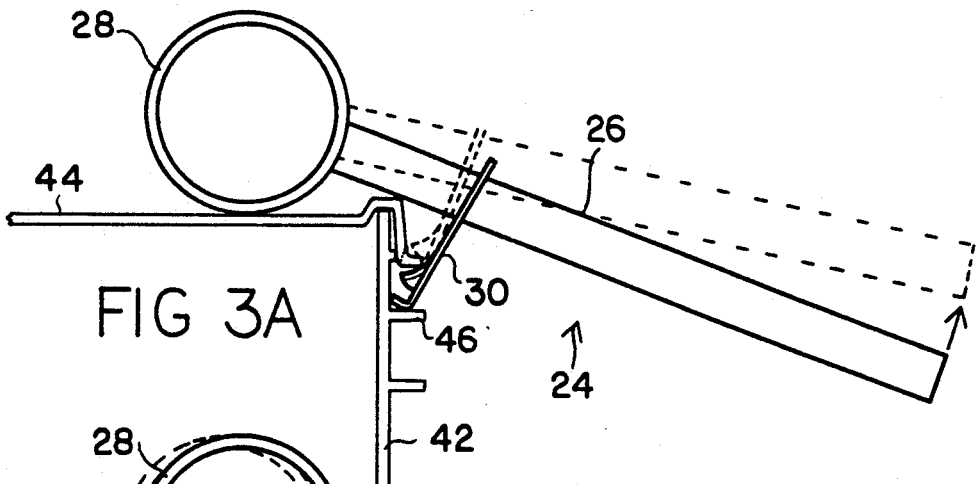
FIG. 3A is an abbreviated isometric view showing the placement of the cutting blade of the lid removal tool in FIG. 2 at the bottom of a slot or groove on the side wall of a can or bucket.
Figure 3B:
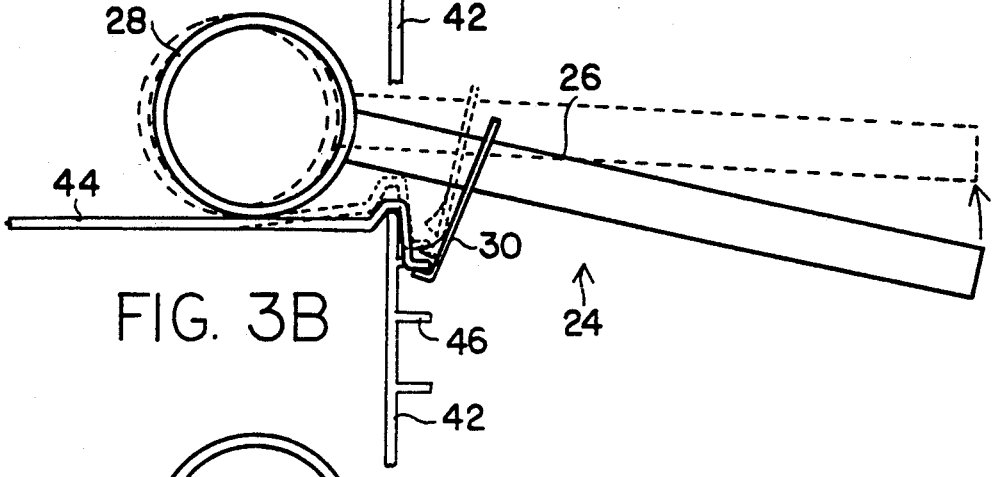
FIG. 3B is an abbreviated isometric view illustrating the upward torquing motion of the lid removal tool which operates to first blade-cut through the groove or slot and second to continue in the same upward thrust motion to pry the lid off the top of the can or bucket.
Figure 4:
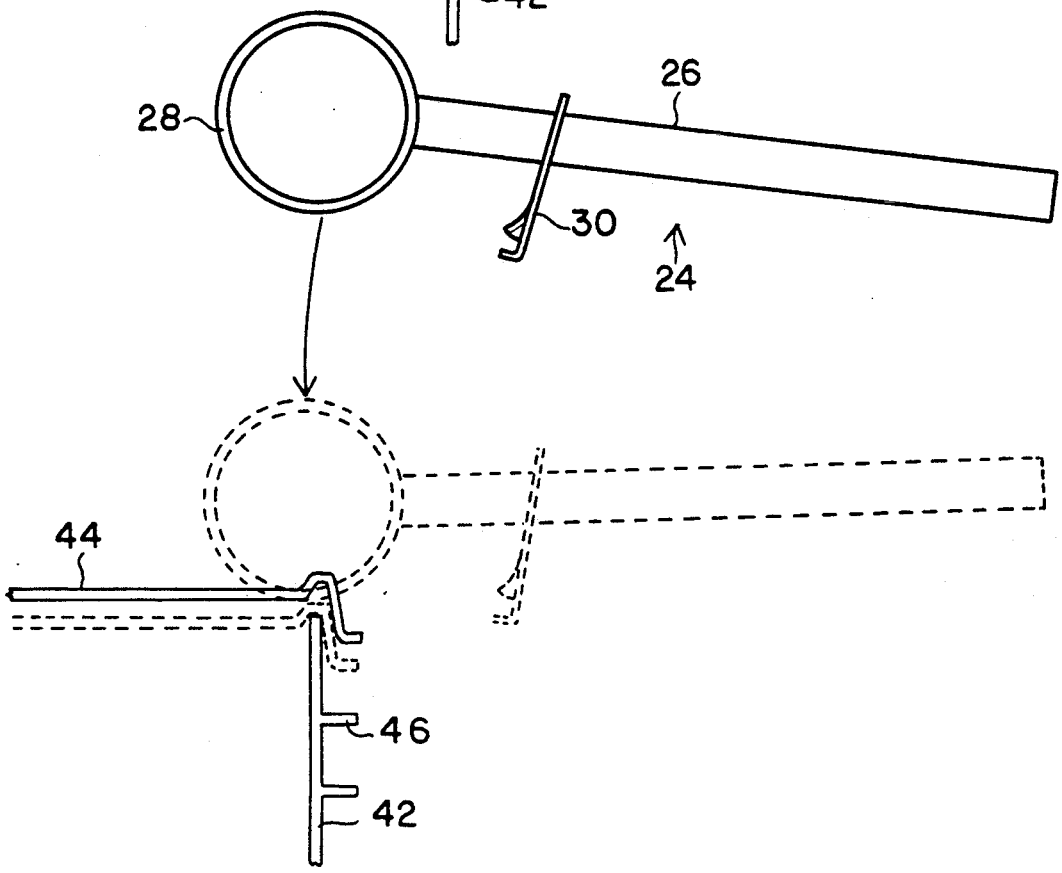
FIG. 4 is an isometric view showing how the tool in FIG. 2 may advantageously be used to seal the cover back on the can or bucket.

Referring now in sequence to FIGS. 3A, 3B, and 4, there is shown in FIG. 3A the positioning of the tool in FIG. 2 so that the cutting edge of the blade 40 is initially placed directly at the lower ends of the slots or grooves within the can's outer vertical walls. This positioning of the tool blade allows the first upward thrust of the tool handle 26 in FIG. 2 to cause the blade 40 to cut through these slots or grooves and thereby initially release tension created by press fitting the lid 42 on the upper rim of a paint can or bucket. This slot or groove is not seen in FIGS. 3A and 3B, but extends vertically upward from the upper rim element 46 by about 4–6 inches.

In FIG. 3B, the tool has been removed from the lid and the lid edge has now been inserted between the lower end 42 of the blade 40 and the upwardly facing surfaces of the hook ends 36 and 38. In this manner, by firmly press fitting the edge of the lid tightly between the end 42 of the cutting blade 40 and the upwardly facing surfaces 36 and 38 of the hook member 30, twisting and slippage of the lid removal tool 24 on the lid during lid removal is thereby minimized to in turn enhance the mechanical advantage and efficiency of tool operation.

Referring now to FIG. 4, there is shown how the heavy cylindrical steel hammer 28 may be advantageously used to replace the lid on the can in addition to being the pivotal element of rotation during the lid removal process.

Various modifications may be made in and to the above described embodiment without departing from the spirit and scope of this invention. For example, the various dimensions and geometry given above for the various elements of the tool 24 may be varied in accordance with corresponding variations in lid size and geometry for the lids being removed. Also, the hammer is not limited to the cylindrical shape shown, and may take other geometrical shapes such as spherical, etc. Accordingly, these and other design and construction modifications are clearly within the scope of the following appended claims.

I claim:

1. A lid removal tool including a handle from which a hook member extends and includes a slot, said slot having a pair of hook members on each side thereof and a cutting blade extending within said slot and being spaced from curved ends of said hook members by at least a thickness dimension of said lid and partially shielded in said slot from user exposure.

2. The lid removal tool defined in claim 1 which further includes a cylindrical hammer member affixed to one end of said handle.

3. The lid removal tool defined in claim 1 wherein said blade and hook members are spaced apart by a predetermined thickness dimension of a lid cover to be removed.

4. The lid removal tool defined in claim 3 wherein said hook member extends from said handle at a predetermined angle with respect to vertical.

5. The lid removal tool defined in claim 4 wherein said blade has a same general contour and curvature as said pair of hook members.

6. The lid removal tool defined in claim 5 wherein said hammer is cylindrical in shape and said predetermined angle is approximately 10–15 degrees.

7. The lid removal tool defined in claim 6 wherein said hook member is spaced from said hammer by a distance on the order of about 2⅛ inches.

* * * * *